US009228151B1

(12) United States Patent
Simonetti

(10) Patent No.: US 9,228,151 B1
(45) Date of Patent: Jan. 5, 2016

(54) LUBRICANT ADDITIVE COMPOSITION, LUBRICANT, AND METHOD OF PREPARING THE SAME

(71) Applicant: RAND Innovations, LLC, Westport, CT (US)

(72) Inventor: Mark Simonetti, Westport, CT (US)

(73) Assignee: RAND INNOVATIONS, LLC, Westport, CT (US)

( * ) Notice: Subject to any disclaimer, the term of this patent is extended or adjusted under 35 U.S.C. 154(b) by 0 days.

(21) Appl. No.: 14/072,226

(22) Filed: Nov. 5, 2013

Related U.S. Application Data

(60) Provisional application No. 61/723,543, filed on Nov. 7, 2012.

(51) Int. Cl.

| | |
|---|---|
| ***C10M 125/22*** | (2006.01) |
| ***C10M 125/26*** | (2006.01) |
| ***C10M 141/08*** | (2006.01) |
| ***C10M 141/10*** | (2006.01) |
| ***C10M 141/12*** | (2006.01) |

(52) U.S. Cl.
CPC ..... *C10M 141/12* (2013.01); *C10M 125/22* (2013.01); *C10M 125/26* (2013.01); *C10M 141/08* (2013.01); *C10M 141/10* (2013.01)

(58) Field of Classification Search
CPC ..... C10M 125/02; C10M 125/22; C10M 125/26; C10M 129/68; C10M 133/30; C10M 141/08; C10M 141/10; F41A 29/04
See application file for complete search history.

(56) References Cited

U.S. PATENT DOCUMENTS

| | | | | |
|---|---|---|---|---|
| 3,518,917 | A * | 7/1970 | Sluhan | 409/131 |
| 3,645,901 | A | 2/1972 | Matson | |
| 3,915,870 | A * | 10/1975 | Brown | 508/125 |
| 3,968,302 | A * | 7/1976 | Brown | 428/328 |
| 4,584,115 | A | 4/1986 | Davis | |
| 4,758,362 | A | 7/1988 | Butke | |
| 4,889,647 | A | 12/1989 | Rowan et al. | |
| 4,997,969 | A | 3/1991 | Luciani | |
| 5,137,647 | A | 8/1992 | Karol | |
| 5,399,274 | A * | 3/1995 | Marcus | 508/195 |
| 5,412,130 | A | 5/1995 | Karol | |
| 7,195,828 | B2 | 3/2007 | Gunsel et al. | |
| 7,205,423 | B1 | 4/2007 | Gershon et al. | |
| 7,749,947 | B2 | 7/2010 | Griffo et al. | |
| 7,763,744 | B2 | 7/2010 | Tynik et al. | |
| 2002/0086168 | A1* | 7/2002 | Sadvary et al. | 428/447 |
| 2004/0138073 | A1* | 7/2004 | Karol et al. | 508/195 |
| 2005/0124504 | A1 | 6/2005 | Zhang et al. | |
| 2008/0234154 | A1 | 9/2008 | Boudreau | |
| 2009/0048129 | A1 | 2/2009 | Mabuchi et al. | |
| 2009/0155479 | A1 | 6/2009 | Xiao et al. | |
| 2010/0040864 | A1 | 2/2010 | McGilvray et al. | |
| 2010/0048436 | A1* | 2/2010 | Litters et al. | 508/174 |
| 2010/0113312 | A1 | 5/2010 | Ward et al. | |
| 2010/0187925 | A1 | 7/2010 | Tingler et al. | |
| 2010/0199943 | A1 | 8/2010 | Carrick | |
| 2012/0214717 | A1 | 8/2012 | McLaughlin et al. | |
| 2012/0302472 | A1* | 11/2012 | Litters et al. | 508/122 |
| 2012/0304545 | A1 | 12/2012 | Park et al. | |
| 2014/0371119 | A1 | 12/2014 | Mosleh | |

FOREIGN PATENT DOCUMENTS

| | | | |
|---|---|---|---|
| EP | 2195404 | B1 | 7/2012 |
| GB | 2437821 | A | 11/2007 |
| GB | 2454103 | A | 4/2009 |
| WO | 2007082299 | A2 | 7/2007 |
| WO | 2010085802 | A1 | 7/2010 |
| WO | 2011011714 | A1 | 1/2011 |
| WO | 2011099823 | A2 | 8/2011 |

OTHER PUBLICATIONS

Wiesel, Inna et al.: "Synthesis of WS2 and MoS2 Fullerene-Like Nanoparticles from Solid Precursors", Nano Res (2009), vol. 2, pp. 416-424.

Rapoport, L, et al., "Hollow nanoparticles of WS2 as potential solid-state lubricants", Nature, Jun. 19, 1997, vol. 387, pp. 791-793.

* cited by examiner

*Primary Examiner* — Joseph D Anthony
(74) *Attorney, Agent, or Firm* — Cantor Colburn LLP

(57) ABSTRACT

A lubricant additive composition including: a borate including an alkali metal borate, an alkaline earth metal borate, or a combination thereof; tungsten disulfide including particles having a particle diameter of 4 to 160 nanometers; an anti-scuff agent including a metal dithiocarbamate, a metal dialkyldithiocarbamate, a metal dithiophosphate, a metal dialkyldithiophosphate, or a combination thereof; a borate ester; and a base oil.

33 Claims, No Drawings

LUBRICANT ADDITIVE COMPOSITION, LUBRICANT, AND METHOD OF PREPARING THE SAME

This Application claims priority to U.S. Provisional Patent Application No. 61/723,543, filed on Nov. 7, 2012, the content of which is incorporated herein by reference in its entirety.

BACKGROUND

1) Field of the Invention

Disclosed is a lubricant additive composition, a lubricant, and method of preparing the same. The lubricant additive composition may be used to treat a base oil to provide improved performance.

2) Description of the Related Art

Lubrication involves friction reduction by maintaining a film of a lubricant between adjacent surfaces that move with respect to each other. The lubricant film prevents direct contact of the adjacent surfaces, greatly reducing the coefficient of friction and wear of the surfaces. In addition to this function, the lubricant film also can provide functions such as heat removal, containment of contaminants, and other important functions.

Commercially available lubricants are a mixture of a base oil, e.g., a hydrocarbon oil, and one or more additives. The additives are used to establish or enhance various properties of the lubricant. Because additives and the base oil may interact both physically and chemically, and because an additive may affect multiple properties of the base oil, formulation of additives can be complex. For example, certain anti-wear agents are known to accelerate corrosion; flow improvers can reduce viscosity, and some dispersants and viscosity improvers are known to interact with base oils to degrade cloud point and pour point properties.

For certain applications, such as in industrial machinery or in fleet vehicles, reducing friction and wear can be especially desirable. Reducing friction losses can result in a variety of benefits, including improved fuel economy and reduced engine operating temperature. Reducing wear can also provide a variety of additional benefits, including extended life, reduced maintenance costs, and improved reliability. Furthermore, for certain applications, a lubricant that is substantially free of certain elements, such as phosphorous, can be desirable for certain applications.

Many studies have been made on additives, e.g., friction modifiers, to provide reduced friction and wear. Nonetheless, there remains a need for an improved lubricant additive composition and lubricant that can provide improved performance.

SUMMARY

Disclosed is a lubricant additive composition including: a borate including an alkali metal borate, an alkaline earth metal borate, or a combination thereof; tungsten disulfide including particles having a diameter of 4 to 160 nanometers; an anti-scuff agent including a metal dithiocarbamate, a metal dialkyldithiocarbamate, a metal dithiophosphate, a metal dialkyldithiophosphate, or a combination thereof; a borate ester; and a base oil.

Also disclosed is a lubricant including: the lubricant additive composition disclosed above; and an additional base oil, wherein the base oil and the additional base oil are the same or different.

Also disclosed is a method of manufacturing a lubricant additive composition, the method including: contacting a borate including an alkali metal borate, an alkaline earth metal borate, or a combination thereof; tungsten disulfide including particles having a particle diameter of 4 to 160 nanometers; a borate ester; an anti-scuff agent including a metal dithiocarbamate, a metal dialkyldithiocarbamate, a metal dithiophosphate, a metal dialkyldithiophosphate, or a combination thereof; and a base oil under conditions effective to disperse the tungsten disulfide, the borate ester, and the anti-scuff agent in the base oil to manufacture the lubricant additive composition.

Also disclosed is a method of manufacturing a lubricant, the method including: contacting the lubricant additive composition manufactured as disclosed above with an additional base oil, wherein the base oil and the additional base oil are the same or different.

Also disclosed is a method of lubricating an engine, the method including: providing the lubricant additive composition disclosed above; and adding the lubricant additive to an engine to lubricate the engine.

These and other features, aspects, and advantages of the disclosed embodiments will become better understood with reference to the following description and appended claims.

DETAILED DESCRIPTION

Disclosed is a lubricant additive composition comprising: a borate comprising an alkali metal borate, an alkaline earth metal borate, or a combination thereof; tungsten disulfide comprising particles having a particle diameter of 4 to 160 nanometers; and a base oil. The lubricant additive may further comprise an anti-scuff agent comprising a metal dithiocarbamate, a metal dialkyldithiocarbamate, a metal dithiophosphate, a metal dialkyldithiophosphate, or a combination thereof. The lubricant additive may also further comprise a borate ester.

Also disclosed is a lubricant additive composition comprising a borate comprising an alkali metal borate, an alkaline earth metal borate, or a combination thereof; tungsten disulfide comprising particles having a particle diameter of 4 to 160 nanometers; an anti-scuff agent comprising a metal dithiocarbamate, a metal dialkyldithiocarbamate, a metal dithiophosphate, a metal dialkyldithiophosphate, or a combination thereof; a borate ester; and a base oil. The lubricant additive composition can be used alone or in combination with an additional base oil to provide improved tribological properties, including reduced friction. When used in an engine, such as a motor oil in a gasoline or in a diesel engine, improved fuel economy is provided.

The borate may comprise an alkali metal borate, an alkaline earth metal borate, or a combination thereof. The alkali metal borate may comprise Li, Na, K, Rb, or a combination thereof. The alkaline earth metal borate may comprise Mg, Ca, Sr, Ba, or a combination thereof. A combination of the alkali metal borate and the alkaline earth metal borate is specifically mentioned. In an embodiment the borate comprises K, Ca, or a combination thereof. The borate may be sodium borate, a potassium borate, a magnesium borate, a calcium borate, or a combination thereof. Potassium borate is specifically mentioned. The potassium borate may be potassium metaborate, potassium pentaborate, potassium tetraborate, potassium triborate, or a combination thereof. The potassium borate may be $KBO_2$, $KB_5O_8.4H_2O$, $KBO_2.½H_2O$, $K_2B_4O_7.4H_2O$, $K_2B_4O_7.8H_2O$, $KB_3O_5.3H_2O$, or a combination thereof.

An atomic ratio of an alkali metal, an alkaline earth, or a combination thereof of the borate to boron of the borate may be of 3:2 to 1:5, specifically 1:1 to 2:9, more specifically 1:2 to 1:4. In an embodiment, an atomic ratio of potassium to boron of the borate is 1:1 to 1:5.

The borate may be a hydrate or may be anhydrous. The borate may comprise 0 to 10 moles of water, specifically 0.1 to 9 moles of water, more specifically 0.2 to 8 moles of water, per mole of the borate. In an embodiment the borate is anhydrous.

The borate may comprise particles having a particle diameter (e.g., a particle size) of 1 to 200 nanometers (nm), specifically 2 to 150 nm, more specifically 4 to 100 nm, or 6 to 50 nm. A borate comprising particles having a particle diameter of less than 50 nm is specifically mentioned. The borate may comprise particles having an average particle diameter (i.e., an average particle diameter, e.g., an average largest particle size) of 5 to 150 nm, specifically 10 to 100 nm, more specifically 15 to 50 nm.

The borate may have any suitable shape, and may be in the form of a sphere, plate, rod, disk, tube, or a combination thereof. Also, the borate may have various cross-sectional shapes, such as a rectilinear or a curvilinear shape, such as a rectangular, triangular, polygonal, oval, elliptical, or circular cross-sectional shape, or a combination thereof.

The borate may be contained in the lubricant additive composition in an amount of 0.01 to 10 weight percent (wt %), specifically 0.05 to 5 wt %, more specifically 0.1 to 2 wt %, based on a total weight of the lubricant additive composition. In an embodiment, the borate may be contained in the lubricant additive composition in an amount of 0.0001 to 0.10 weight percent (wt %), specifically 0.0005 to 0.05 wt %, more specifically 0.001 to 0.02 wt %, based on a total weight of the lubricant additive composition. The borate may be provided in the form of a suspension or dispersion of the borate in base oil. A dispersion of potassium borate in polyalphaolefin is specifically mentioned.

The lubricant additive composition also comprises tungsten disulfide. While not wanting to be bound by theory, it is understood that the tungsten disulfide of the lubricant additive composition may have a layered crystal structure comprising layers of tungsten atoms in a hexagonal arrangement interposed between sulfur layers. The bonding between the layers is understood to be primarily a Van der Waals type interaction and weak as compared to the bond strength within the W or S layers. When a force is applied in the direction of the layers, the weak bonding between the layers allows the layers to shear easily, providing a laminar lubricating mechanism that can provide superior lubricity.

The tungsten disulfide may have any suitable shape, and may be in the form of a sphere, plate, rod, disk, tube, or a combination thereof. Also, the tungsten disulfide may have various cross-sectional shapes, such as a rectilinear or a curvilinear shape, such as a rectangular, triangular, polygonal, oval, elliptical, or circular cross-sectional shape, or a combination thereof. In an embodiment the tungsten disulfide has a structure comprised of closed polyhedra to provide a fullerene-like structure, e.g., a buckeye-ball like structure or a nanotube structure. In an embodiment the tungsten disulfide may have a multiply layered structure in which each layer comprises closed polyhedral to provide a fullerene-like, onion, or multiwall nanotube structure. Inorganic-fullerene tungsten disulfide is specifically mentioned. While not wanting to be bound by theory, it is understood that inorganic-fullerene tungsten disulfide comprises multiwall spheres of tungsten disulfide. The preparation of inorganic-fullerene tungsten disulfide has been described in Inna Wiesel, Hamutal Arbel, Ana Albu-Yaron, Ronit Popovitz-Biro, Jeffrey M. Gordon, Daniel Feuermann, and Reshef Tenne, Synthesis of $WS_2$ and $MoS_2$ Fullerene-Like Nanoparticles from Solid Precursors, Nano Res (2009) 2: 416 424, the contents of which in its entirety is herein incorporated by reference. While not wanting to be bound by theory, it is understood that the spherical shape of the inorganic-fullerene tungsten disulfide further promotes reduction of friction in concert with the layered crystal structure of tungsten disulfide.

The tungsten disulfide can further comprise a passivating layer. The passivating layer may comprise, for example, a tungsten oxide (e.g., $WO_3$) on the surface of the $WS_2$ particles. The tungsten oxide passivating layer can inhibit oxidation, and can also have desirable friction properties. In addition it is understood that the tungsten disulfide can adhere to metal surfaces, and can aid in the burnishing of wearing surfaces, thereby providing additional friction reduction and reduced wear. Furthermore, because of the burnishing properties provided by the tungsten disulfide, the tungsten disulfide can aid in the restoration and/or polishing of components. Thus, while not wanting to be bound by theory, it is understood that the tungsten disulfide provides a variety of desirable lubricating properties.

A direction of the tungsten disulfide may be aligned with a direction of moving surfaces, further reducing friction. For example, in an embodiment in which the tungsten disulfide has a rectilinear shape, e.g., is in the form of platelet, the tungsten disulfide may be aligned such that the major surface of the tungsten disulfide is parallel to the direction of the moving surfaces. Also, the tungsten and sulfur layers of the tungsten disulfide may be parallel to the major surface of the tungsten disulfide particle (e.g., a major surface of a platelet), and thus the tungsten and sulfur layers may be parallel to the direction of the moving surfaces.

The tungsten disulfide may comprise particles having a particle diameter (e.g., a particle size) of 4 to 160 nm, specifically 6 to 140 nm, more specifically 8 to 120 nm, or 10 to 80 nm. Tungsten disulfide comprising particles having a particle diameter of 8 to 40 nm is specifically mentioned. The tungsten disulfide may comprise particles having an average particle diameter (e.g., an average particle size) of 10 to 1000 nm, specifically 20 to 800 nm, more specifically 40 to 600 nm, or 10 to 400 nm, or 20 to 200 nm. Also, the tungsten disulfide may be contained in the lubricant additive composition in an amount of 0.001 to 1 weight percent (wt %), specifically 0.005 to 0.5 wt %, more specifically 0.01 to 0.1 wt %, based on the total weight of the lubricant additive composition. In an embodiment, the tungsten disulfide may be contained in the lubricant additive composition in an amount of 0.00001 to 0.01 weight percent (wt %), specifically 0.00005 to 0.005 wt %, more specifically 0.0001 to 0.001 wt %, based on the total weight of the lubricant additive composition.

The lubricant additive composition may also comprise an anti-scuff agent comprising a metal dithiophosphate, a metal dithiocarbamate, a metal dialkyldithiophosphate, a metal dialkyldithiocarbamate, or a combination thereof. A metal of the anti-scuff agent may be zinc, antimony, lead, molybdenum, or a combination thereof. An embodiment in which the metal of the anti-scuff agent is antimony is specifically mentioned. The anti-scuff agent may be provided in the form of a solution or suspension of the anti-scuff agent in a base oil.

The metal dithiocarbamate may be zinc dithiocarbamate, antimony dithiocarbamate, lead dithiocarbamate, molybdenum dithiocarbamate, or a combination thereof. In an embodiment the anti-scuff agent comprises antimony dithiocarbamate. An embodiment in which the anti-scuff agent consists of antimony dithiocarbamate is specifically mentioned.

The metal dithiophosphate may be zinc dithiophosphate, antimony dithiophosphate, lead dithiophosphate, molybdenum dithiophosphate, or a combination thereof. Antimony dithiophosphate is specifically mentioned.

In an embodiment, the metal dialkyldithiophosphate comprises a zinc dialkyldithiophosphate of Formula 1:

(1)

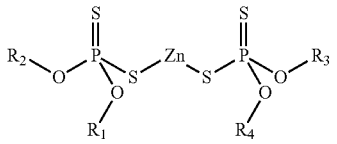

wherein in Formula 1, $R_1$, $R_2$, $R_3$ and $R_4$ are each independently hydrogen, a substituted or unsubstituted C1 to C20 alkyl group, a substituted or unsubstituted C6 to C26 cycloalkyl group, a substituted or unsubstituted C6 to C26 aryl group, a substituted or unsubstituted C6 to C26 alkylaryl group, or a substituted or unsubstituted C6 to C26 arylalkyl group. An embodiment in which $R_1$, $R_2$, $R_3$ and $R_4$ are each hydrogen, and an embodiment in which $R_1$, $R_2$, $R_3$ and $R_4$ are each dimethylphenyl are specifically mentioned. In an embodiment the zinc dialkyldithiophosphate is zinc bis(dixylyl)bis(dithiophosphate), e.g., zinc bis[o,o-bis(dimethylphenyl)phosphorodithioato-S,S'].

In an embodiment, the metal dialkyldithiophosphate comprises an antimony dialkyldithiophosphate of Formula 2:

(2)

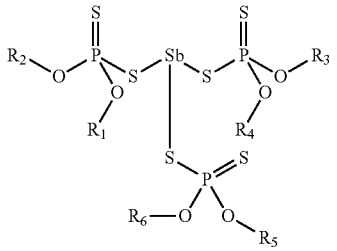

wherein in Formula 2, $R_1$, $R_2$, $R_3$, $R_4$, $R_5$, and $R_6$ are each independently hydrogen, a substituted or unsubstituted C1 to C20 alkyl group, a substituted or unsubstituted C6 to C26 cycloalkyl group, a substituted or unsubstituted C6 to C26 aryl group, a substituted or unsubstituted C6 to C26 alkylaryl group, or a substituted or unsubstituted C6 to C26 arylalkyl group. An embodiment in which $R_1$, $R_2$, $R_3$, $R_4$, $R_5$, and $R_6$ are each hydrogen, and an embodiment in which $R_1$, $R_2$, $R_3$, $R_4$, $R_5$, and $R_6$ are each dimethylphenyl are specifically mentioned.

In an embodiment, the metal dialkyldithiophosphate comprises a molybdenum dialkyldithiophosphate of Formula 3:

(3)

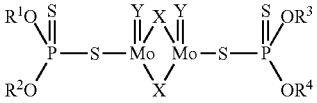

wherein in Formula 3, $R_1$, $R_2$, $R_3$, and $R_4$ are each independently hydrogen, a substituted or unsubstituted C1 to C20 alkyl group, a substituted or unsubstituted C6 to C26 cycloalkyl group, a substituted or unsubstituted C6 to C26 aryl group, a substituted or unsubstituted C6 to C26 alkylaryl group, or a substituted or unsubstituted C6 to C26 arylalkyl group, and X and Y are each independently O or S. An embodiment in which $R_1$, $R_2$, $R_3$ and $R_4$ are each hydrogen, and an embodiment in which $R_1$, $R_2$, $R_3$ and $R_4$ are each dimethylphenyl are specifically mentioned. In an embodiment, X and Y in Formula 3 are O and S, respectively.

In an embodiment, the metal dialkyldithiocarbamate is a zinc dialkyldithiocarbamate of Formula 4:

(4)

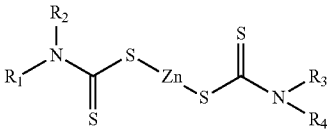

wherein in Formula 4, $R_1$, $R_2$, $R_3$, and $R_4$ are each independently hydrogen, a substituted or unsubstituted C1 to C20 alkyl group, a substituted or unsubstituted C6 to C26 cycloalkyl group, a substituted or unsubstituted C6 to C26 aryl group, a substituted or unsubstituted C6 to C26 alkylaryl group, or a substituted or unsubstituted C6 to C26 arylalkyl group. An embodiment in which $R_1$, $R_2$, $R_3$ and $R_4$ are each hydrogen, and an embodiment in which $R_1$, $R_2$, $R_3$ and $R_4$ are each dimethylphenyl are specifically mentioned.

In an embodiment, the metal dialkyldithiocarbamate is an antimony dialkyldithiocarbamate of Formula 5:

(5)

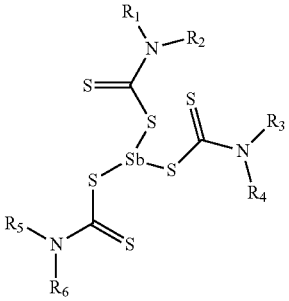

wherein in Formula 5, $R_1$, $R_2$, $R_3$, $R_4$, $R_5$ and $R_6$ are each independently hydrogen, a substituted or unsubstituted C1 to C20 alkyl group, a substituted or unsubstituted C6 to C26 cycloalkyl group, a substituted or unsubstituted C6 to C26 aryl group, a substituted or unsubstituted C6 to C26 alkylaryl group, or a substituted or unsubstituted C6 to C26 arylalkyl group. An embodiment in which $R_1$, $R_2$, $R_3$, $R_4$, $R_5$ and $R_6$ are a C1 to C10 alkyl group, and an embodiment in which $R_1$, $R_2$, $R_3$, $R_4$, $R_5$ and $R_6$ are each dimethylphenyl are specifically mentioned. In an embodiment the antimony dialkyldithiocarbamate is antimony dipentyldithiocarbamate. The antimony dialkyldithiocarbamate may be used in the form of a solution or suspension in a base oil. Tiraco product Octopol AD, which comprises antimony dipentyldithiocarbamate, is specifically mentioned.

In an embodiment, the metal dialkyldithiocarbamate is a lead dialkyldithiocarbamate of Formula 6:

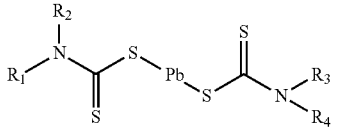

(6)

wherein in Formula 6, $R_1$, $R_2$, $R_3$, and $R_4$ are each independently hydrogen, a substituted or unsubstituted C1 to C20 alkyl group, a substituted or unsubstituted C6 to C26 cycloalkyl group, a substituted or unsubstituted C6 to C26 aryl group, a substituted or unsubstituted C6 to C26 alkylaryl group, or a substituted or unsubstituted C6 to C26 arylalkyl group. An embodiment in which $R_1$, $R_2$, $R_3$, $R_4$, $R_5$ and $R_6$ are each hydrogen, and an embodiment in which $R_1$, $R_2$, $R_3$ and $R_4$ are each dimethylphenyl are specifically mentioned. Lead dimethyldithiocarbamate is specifically mentioned.

In an embodiment, the metal dialkyldithiocarbamate is a molybdenum dialkyldithiocarbamate. Molybdenum dialkyldithiocarbamates are disclosed in U.S. Pat. No. 7,763,744, the content of which in its entirety are incorporated herein by reference. While not wanting to be bound by theory, it is understood that the molybdenum dialkyldithiocarbamate may be according to Formula 7:

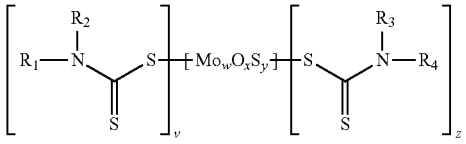

(7)

wherein in Formula 7, $R_1$, $R_2$, $R_3$, and $R_4$ are each independently hydrogen, a substituted or unsubstituted C1 to C20 alkyl group, a substituted or unsubstituted C6 to C26 cycloalkyl group, a substituted or unsubstituted C6 to C26 aryl group, a substituted or unsubstituted C6 to C26 alkylaryl group, or a substituted or unsubstituted C6 to C26 arylalkyl group, v is 1 to 2, w is 1 to 2, x+y is 2 to 5, and z is 1 to 2. Molybdenum dialkyldithiocarbamates are commercially available from R.T. Vanderbilt Company, Inc. of Norwalk, Conn.

The anti-scuff agent may be contained in an amount of 0.01 to 20 weight percent, specifically 0.1 to 15 weight percent, more specifically 1 to 10 weight percent, based on a total weight of the lubricant additive composition. In an embodiment, the anti-scuff agent may be contained in an amount of 0.0001 to 0.2 weight percent, specifically 0.001 to 0.15 weight percent, more specifically 0.001 to 0.1 weight percent, based on a total weight of the lubricant additive composition.

The lubricant additive composition may also comprise a borate ester. While not wanting to be bound by theory, it is understood that the borate ester bonds to metal surfaces to provide a lubricious surface, reducing friction between adjacent moving surfaces. The borate ester compound may act as an inhibitor for corrosion of metal to prevent corrosion of either ferrous or non-ferrous metals (e.g. copper, bronze, brass, titanium, or aluminum) or both, when present in concentrations effective to inhibit corrosion. Furthermore, the borate ester may act as a dispersant and can provide desirable antiwear and antioxidant properties.

The borate ester may be a reaction product of a boron compound and an epoxy compound, a halohydrin compound, an epihalohydrin compound, a polyol, or a combination thereof. The polyol may be a monol, diol, triol, or a higher polyol. Boron compounds suitable for preparing the borate ester include boric acid, including metaboric acid, $HBO_2$, orthoboric acid, $H_3BO_3$, and tetraboric acid, $H_2B_4O_7$, boric oxide, boron trioxide, or an alkyl borate. The borate ester may also be prepared from a boron halide. The borated ester may contain at least one hydrocarbyl group, specifically a C4 to C30 hydrocarbyl group.

Borated epoxides are described in detail in U.S. Pat. No. 4,584,115, the content of which is incorporated herein by reference in its entirety. The borated epoxide may be prepared by reacting an epoxide with boric acid or boron trioxide. Borated epoxides are not actually epoxides, but are the boron-containing reaction products of epoxides and may be a borate ester. The epoxides can be commercial mixtures of C14-16 or C14-18 epoxides, which can be purchased from ELF-ATOCHEM or Union Carbide and which can be prepared from the corresponding olefins by known methods. Purified epoxy compounds such as 1,2-epoxyhexadecane can be purchased from Aldrich Chemicals. The borated compounds may be prepared by blending the boron compound and the epoxide and heating them at a suitable temperature, e.g., 80 to 250° C., optionally in the presence of an inert liquid medium, until the desired reaction has occurred. A suitable borated epoxide is the borated epoxide of a C16 olefin.

Representative borate esters include trimethyl borate, triethyl borate, tri-n-propyl borate, tri-n-butyl borate, triphenyl borate, triisopropyl borate, tri-t-amyl borate, triphenyl borate, trimethoxy boroxine, tri-2-cyclohexylcyclohexyl borate, a trialkanolamine borate such as triethanolamine borate or triisopropanolamine borate, manittol borate, and glycerol borate.

Additionally, other amino-containing borates and tertiary amine salts of boric acid may be useful. Such boron-containing compounds include, but are not limited to, 2-(beta-dimethylaminoisopropoxy)-4,5-dimethyl-1,3,2-dioxaborolane, 2-(beta-diethylaminoethoxy)4,4,6-trimethyl-1,3,2-dioxaborinane, 2-(beta-dimethylaminoethoxy)-4,4,6-trimethyl-1,3,2-dioxaborinane, 2-(betha-diisopropylaminoethoxy-1,3,2-dioxaborinane, 2-(beta-dibutylaminoethoxy)-4-methyl-1,3,2-dioxaborinane, 2-(gamma-dimethylaminopropoxy)-1,3,6,9-tetrapxa-2-boracycloundecane, and 2-(beta-dimethylaminoethoxy)-4,4-(4-hydorxybutyl)-1,3,2-dioxaborolane.

The borate ester may be a reaction product of a fatty oil and a C2 to C10 dialkanolamine, and subsequent reaction with a boric acid or other suitable reagent effective to form a borate ester. The fatty oil may be a glyceryl ester of a C6 to C30 fatty acid, specifically a glyceryl ester of a C12 to C22 fatty acid. In an embodiment, the C2 to C10 dialkanolamine is diethanolamine. The borated ester may be a reaction product of 1 mole of the fatty oil and 1 to 2.5 moles of diethanolamine followed by reaction with boric acid as provided in U.S. Patent Publication No. 2004/0138073, the content of which in its entirety is herein incorporated by reference.

The borate ester may comprise a compound of Formula 8:

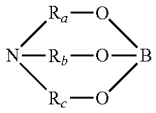

(8)

wherein in Formula 8, Ra, Rb, and Rc are each independently a substituted or unsubstituted C1 to C20 alkylene group, a substituted or unsubstituted C6 to C26 cycloalkylene group, a substituted or unsubstituted C6 to C26 arylene group, a substituted or unsubstituted C6 to C26 alkylarylene group, or a substituted or unsubstituted C6 to C26 arylalkylene group. Representative borate esters include trimethanolamine borate, triethanolamine borate, and tri-n-propanolamine borate, triisopropanolamine borate. In an embodiment, Ra, Rb, and Rc are each a C1 to C20 alkylene group. An embodiment in which Ra, Rb, and Rc are each isopropyl (to provide triisopropanolamine borate) is specifically mentioned.

The content of boron in the borate ester may be 0.1 to 3 wt %, specifically 0.5 to 2 wt %, based on a total weight of the borate ester. The borate ester may be contained in the lubricant additive composition in an amount of 0.01 to 20 weight percent, specifically 0.1 to 15 weight percent, more specifically 1 to 10 weight percent, based on a total weight of the lubricant additive composition. In an embodiment, the borate ester may be contained in the lubricant additive composition in an amount of 0.0001 to 0.2 weight percent, specifically 0.001 to 0.15 weight percent, more specifically 0.001 to 0.1 weight percent, based on a total weight of the lubricant additive composition. A representative borate ester is VANLUBE 289, available from R.T. Vanderbilt Co., Norwalk, Conn. Triisopropanolamine borate is also specifically mentioned.

It has been unexpectedly found that the borate and the tungsten disulfide, when suitably dispersed in a base oil, provide a synergistic improvement in friction properties. It has been further unexpectedly found that the borate, the tungsten disulfide, the anti-scuff agent, and the borate ester, when suitably dispersed in a base oil, provide additional synergistic improvement in friction properties. The synergistic improvement is provided while maintaining or without substantial loss to other desirable properties, such as wear. While not wanting to be bound by theory, it is understood that the borate and the tungsten disulfide, optionally in combination with the anti-scuff agent and the borate ester, synergistically provide form a highly lubricious coating on moving parts, resulting in reduced friction.

The borate and the tungsten disulfide; or the borate, the tungsten disulfide, the anti-scuff agent, and the borate ester, are dispersed in a base oil. The base oil comprises a base stock of one or more of Groups I-V as specified in the American Petroleum Institute (API) Publication 1509, Fourteenth Edition, December 1996 (i.e., API Base Oil Interchangeability Guidelines for Passenger Car Motor Oils and Diesel Engine Oils), which is incorporated herein by reference in its entirety. The API guideline defines a base stock as a lubricant component that may be manufactured using a variety of different processes. Groups I (solvent refined mineral oils), II (hydrocracked mineral oils) and III (severely hydrocracked based oils) base stocks are mineral oils, each with specific ranges of the amount of saturates, sulfur content, and viscosity index. Group IV base stocks are polyalphaolefins (PAOs). Group V base stocks include all other base stocks not included in Group I, II, III, or IV and include esters and naphthenes. A vegetable oil may be used.

In an embodiment, the base oil comprises one or more of the base stocks in Groups I, II, III, IV, V, or a combination thereof. In another embodiment, the base oil comprises one or more of the base stocks in Group II, III, IV, or a combination thereof. In yet another embodiment, the base oil comprises one or more of the base stocks in Group II, III, IV, or a combination thereof. The base oil may have a kinematic viscosity of 2.5 to 20 centistokes (cSt), specifically 4 cSt to 20 cSt, more specifically 5 cSt to 16 cSt at 100° C.

The base oil may comprise a natural oil having a viscosity suitable for lubrication, a synthetic oil having a viscosity suitable for lubrication, or a combination thereof. In an embodiment, the base oil includes a base stock obtained by isomerization of a synthetic wax and a slack wax, as well as hydrocrackate base stock produced by hydrocracking (rather than solvent extracting) the aromatic and polar components of crude oil. In another embodiment, the base oil of lubricating viscosity includes a natural oil such as an animal oil, vegetable oil, mineral oil (e.g., liquid petroleum oil or solvent treated or acid-treated mineral oil of the paraffinic, naphthenic, or mixed paraffinic-naphthenic types), an oil derived from coal or shale, or a combination thereof. Some non-limiting examples of animal oils include bone oil, lanolin, fish oil, lard oil, dolphin oil, seal oil, shark oil, tallow oil, and whale oil. Some non-limiting examples of vegetable oils include castor oil, olive oil, peanut oil, rapeseed oil, corn oil, sesame oil, cottonseed oil, soybean oil, sunflower oil, safflower oil, hemp oil, linseed oil, tung oil, oiticica oil, jojoba oil, and meadow foam oil. Such oils may be partially or fully hydrogenated.

In an embodiment the synthetic oil of lubricating viscosity includes a hydrocarbon oil and a halo-substituted hydrocarbon oil such as a polymerized and/or cross-linked olefin, an alkylbenzene, a polyphenyl, an alkylated diphenyl ether, an alkylated diphenyl sulfide, a derivative, analogues or homologues thereof, or a combination thereof. In another embodiment the synthetic oil includes an alkylene oxide polymer, a cross-linked polymer, a copolymer, or a derivative thereof wherein the terminal hydroxyl groups can be modified by esterification or etherification. In another embodiment the synthetic oil include the ester of a dicarboxylic acids with a variety of alcohols. In an embodiment the synthetic oil include as ester made from a C5 to C12 monocarboxylic acid and a polyol and a polyol ether. In another embodiment the synthetic oil includes a tri-alkyl phosphate ester oil such as tri-n-butyl phosphate or tri-iso-butyl phosphate.

In an embodiment the synthetic oil includes a silicon-based oil (such as the polyalkyl-, polyaryl-, polyalkoxy-, polyaryloxy-siloxane oil or silicate oil). In another embodiment the synthetic oil includes a liquid ester of a phosphorus-containing acid, a polymeric tetrahydrofuran, or a polyalphaolefin.

A base oil derived from the hydroisomerization of wax may also be used, either alone or in combination with the aforesaid natural and/or synthetic base oil. Such wax isomerate oil is produced by the hydroisomerization of natural or synthetic waxes or mixtures thereof over a hydroisomerization catalyst.

In a further embodiment, the base oil comprises a poly-alpha-olefin (PAO). Non-limiting examples of suitable poly-alpha-olefins include those derived from octene, decene, or a combination thereof. The polyalphaolefin may have a viscosity of 2 to 15, specifically 2.5 to 10, more specifically 3 to 7 centistokes, or 3.5 to 6 centistokes at 100° C. In some instances, the poly-alpha-olefin may be used together with another base oil such as a mineral oil. A polyalphaolefin comprising 1-decene is specifically mentioned. In an embodiment the polyalphaolefin comprises 75% to 85% decene trimer, 3% to 23% decene tetramer, and 0.1 to 4% pentamer or higher oligomer. SYNFLUID, a product of Chevron Phillips Chemical Company, specifically SYNFLUID PAO 4 cSt is specifically mentioned.

In an embodiment the base oil comprises a polyalkylene glycol or a polyalkylene glycol derivative, where a terminal hydroxyl group of the polyalkylene glycol may be modified by esterification, etherification, or acetylation. Non-limiting examples of suitable polyalkylene glycols include polyethylene glycol, polypropylene glycol, polyisopropylene glycol, or a combination thereof. Non-limiting examples of suitable polyalkylene glycol derivatives include an ether of a polyalkylene glycol (e.g., methyl ether of polyisopropylene glycol, diphenyl ether of polyethylene glycol, or diethyl ether of polypropylene glycol), a mono- and polycarboxylic ester of a polyalkylene glycol, or a combination thereof. In some instances, the polyalkylene glycol or polyalkylene glycol derivative may be used together with a base oil such as polyalpha-olefin or a mineral oil.

In another embodiment the base oil comprises an ester of a dicarboxylic acid (e.g., phthalic acid, succinic acid, an alkyl succinic acid, an alkenyl succinic acid, maleic acid, azelaic acid, suberic acid, sebacic acid, fumaric acid, adipic acid, linoleic acid dimer, malonic acid, an alkyl malonic acid, or an alkenyl malonic acid) with an alcohol (e.g., butyl alcohol, hexyl alcohol, dodecyl alcohol, 2-ethylhexyl alcohol, ethylene glycol, diethylene glycol monoether, or propylene glycol). Non-limiting examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, or the 2-ethylhexyl diester of linoleic acid dimer.

In another embodiment the base oil comprises a hydrocarbon prepared by the Fischer-Tropsch process. The Fischer-Tropsch process provides a hydrocarbon from gases containing hydrogen and carbon monoxide using a Fischer-Tropsch catalyst. These hydrocarbons may require further processing in order to be useful as a base oil. For example, the hydrocarbon may be dewaxed, hydroisomerized, and/or hydrocracked.

In another embodiment, the base oil comprises an unrefined oil, a refined oil, a rerefined oil, or a combination thereof. An unrefined oil is obtained directly from a natural or synthetic source without further purification treatment. Non-limiting examples of the unrefined oil includes a shale oil obtained directly from a retorting operation, a petroleum oil obtained directly from primary distillation, or an ester oil obtained directly from an esterification process and used without further treatment. A refined oil is similar to the unrefined oil except that the former have been further treated by one or more purification processes to improve one or more properties. Such processes include solvent extraction, secondary distillation, acid or base extraction, filtration, and percolation. The rerefined oil is obtained by applying to a refined oil processes similar to those used to obtain the refined oil. Such rerefined oils are also known as reclaimed or reprocessed oils and often are additionally treated by processes directed to removal of spent additives and oil breakdown products.

An embodiment in which the base oil is an olefin, specifically a polyalphaolefin, more specifically polyalphaolefin 4 (PAO4), is specifically mentioned.

The base oil may comprise 1 weight percent (wt %) to 100 wt %, specifically 2 wt % to 98 wt %, more specifically 4 weight percent (wt %) to 96 wt % of the olefin. An embodiment in which the base oil consists of PAO4 is specifically mentioned. In an embodiment, the base oil may have a viscosity of 1 to 25, specifically 2 to 20, more specifically 3 to 15 centistokes at 100° C. A polyalphaolefin having a viscosity of 4 centistokes at 100° C. is specifically mentioned.

The base oil may be contained in the lubricant additive composition in an amount of 5 to 99.99 wt %, specifically 10 to 99.9 wt %, more specifically 15 to 99 wt %, based on a total weight of the lubricant additive composition.

In an embodiment, the lubricant additive composition further comprises diamond. While not wanting to be bound by theory, it is understood that the diamond provides desirable burnishing properties and can act as nano-size ball bearings, resulting in reduced friction and preventing surface-to-surface contact by filling in imperfections in the moving surfaces. The diamond may have any suitable shape, and may be in the form of spheres, plates, rods, disks, tubes, or a combination thereof. Also, the diamond may have various cross-sectional shapes, such as a rectangular, triangular, polygonal, oval, elliptical, or circular cross-sectional shape, or a combination thereof. Diamond having a spherical shape is specifically mentioned. In an embodiment the diamond has a substantially circular cross-section.

The diamond may be a non-detonation diamond, such as high pressure high temperature diamond, chemical vapor deposition diamond, or ultrasound cavitation diamond, or a combination thereof, or a detonation diamond. A combination of the non-detonation diamond and the detonation diamond can be used. The diamond comprises particles having a particle diameter (e.g., a particle size) of 1 to 50 nm, specifically 2 to 40 nm, more specifically 4 to 30 nm. Diamond comprising particles having a particle diameter of 2 to 25 nm is specifically mentioned. The diamond may comprise particles having an average particle diameter (e.g., an average particle size) of 8 to 1000 nm, specifically 10 to 800 nm, more specifically 12 to 600 nm. Non-detonation diamond having a spherical shape, specifically chemical vapor deposition diamond having a particle size of 2 to 25 nm is specifically mentioned.

The diamond may be contained in the lubricant additive composition in an amount of 0.01 to 3 weight percent (wt %), specifically 0.05 to 2 wt %, more specifically 0.1 to 1 wt %, based on the total weight of the lubricant additive composition. In an embodiment, the diamond may be contained in the lubricant additive composition in an amount of 0.0001 to 0.03 weight percent (wt %), specifically 0.0005 to 0.02 wt %, more specifically 0.001 to 0.01 wt %, based on the total weight of the lubricant additive composition.

In an embodiment, the lubricant additive composition further comprises an organic tungsten composition. While not wanting to be bound by theory, it is understood that the organic tungsten composition promotes the formation of a colloidal dispersion of the borate, the tungsten disulfide, the anti-scuff agent, and the borate ester. In an embodiment the borate, the tungsten disulfide, the anti-scuff agent, and the borate ester form a colloidal dispersion when suitably dispersed in the base oil. When a colloidal dispersion is formed, the dispersed particles, e.g., borate, the tungsten disulfide, the anti-scuff agent, and the borate ester, do not substantially settle and are therefore desirably available to be present at the moving surfaces as opposed to forming a sediment. In addition, in the colloidal dispersion, the aggregation of particles is substantially or effectively prevented, further improving the activity or effectiveness of the borate, the tungsten disulfide, the anti-scuff agent, and the borate ester.

The organic tungsten composition may be a composition as described in U.S. Patent Publication No. 2008/0234154, the content of which is incorporated herein by reference in its entirety. The organic tungsten composition may comprise an organic tungsten complex that is a reaction product of a fatty acid compound and a tungsten salt, wherein the tungsten salt is a reaction product of an acidic tungsten and a nitrogenous base. In particular, the fatty acid compound may be a fatty amide and/or a monoglyceride. The organic tungsten complex may be prepared according to methods disclosed for the analogous organomolybdates in U.S. Pat. Nos. 4,889,647, 5,137,647, 5,412,130, and 7,205,423; the disclosures of which are incorporated herein by reference in their entirety. In an embodiment, the tungsten salt is an ammonium tungstate salt, and the fatty acid compound is a reaction product of a secondary amine and a fatty oil or a fatty acid.

Due to the complex nature of the organic tungsten complex, a specific chemical structure cannot be assigned, however for illustrative purposes a component of the organic tungsten composition can have a structure as shown in Formula 9:

(9)

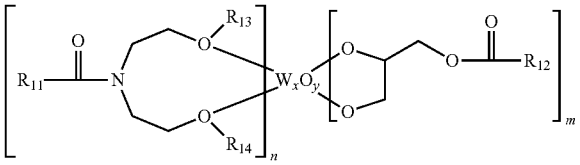

wherein in Formula 9, $R_{11}$ and $R_{12}$ and are each independently a fatty oil residue, $R_{13}$ and $R_{14}$ are each independently hydrogen, a C1 to C25 alkyl group, a C1 to C18 alkoxy substituted alkyl group, or a C2 to C18 amino substituted alkyl group, Q is N or O, the sum of n and m is greater than or equal to 1, x is 1 to 12, and y is greater than or equal to x.

The organic tungsten composition may comprise 5 to 25 wt % tungsten, specifically 10 to 20 wt %, more specifically 12 to 18 wt % tungsten, based on the total weight of the organic tungsten composition. An example of the organic tungsten composition is VANLUBE W-324, available from R.T. Vanderbilt Co., Norwalk, Conn.

The organic tungsten composition may be contained in the lubricant additive composition in an amount of 0.1 to 20 wt %, specifically 1 to 10 wt %, more specifically 2 to 5 wt %, based on a total weight of the lubricant additive composition. In an embodiment, the organic tungsten composition may be contained in the lubricant additive composition in an amount of 0.001 to 0.2 wt %, specifically 0.01 to 0.1 wt %, more specifically 0.02 to 0.05 wt %, based on a total weight of the lubricant additive composition.

The lubricant additive composition may also comprise a dispersant, and the dispersant may comprise a borate and/or a borate ester in addition to the borate ester disclosed above. Use of the dispersant promotes the formation of a dispersion, e.g., a colloidal dispersion, comprising the borate, the tungsten disulfide, the anti-scuff agent, and the borate ester. As previously noted, it has been unexpectedly found that a suitable dispersion comprising borate, the tungsten disulfide, the anti-scuff agent, and the borate ester provides a synergistic improvement in tribological properties. In addition, the dispersant can further prevent a deposit, e.g., a sludge or a varnish, by keeping particles suspended in a colloidal state. While not wanting to be bound by theory, the dispersant can perform these functions via one or more means selected from: (1) solubilizing polar contaminants in their micelles; (2) stabilizing colloidal dispersions in order to prevent aggregation of their particles and their separation out of oil; (3) suspending such products, if they form, in the bulk lubricant; (4) modifying soot to minimize its aggregation and oil thickening; and (5) lowering surface/interfacial energy of undesirable materials to decrease their tendency to adhere to surfaces. The undesirable materials are typically formed as a result of oxidative degradation of the lubricant, the reaction of chemically reactive species such as carboxylic acids with the metal surfaces in the engine, or the decomposition of thermally unstable lubricant additive compositions such as, for example, extreme pressure agents.

In certain aspects, a dispersant molecule comprises three distinct structural features: (1) a hydrocarbyl group; (2) a polar group; and (3) a connecting group or a link. In certain embodiments, the hydrocarbyl group is polymeric in nature, and has a molecular weight of at or above 2000 Daltons (Da), in one embodiment, at or above 3000 Da, in another embodiment, at or above 5000 Da, and in yet another embodiment, at or above 8000 Da. A variety of olefins, such as polyisobutylene, polypropylene, polyalphaolefins, or a combination thereof, can be used to make a suitable polymeric dispersant. In certain embodiments, the polymeric dispersant is a polyisobutylene-derived or a polyester-derived dispersant. The number average molecular weight of the polyisobutylene or the polyester in such dispersants can be 500 to 3000 Da, specifically 800 to 2000 Da, more specifically 1000 to 2000 Da. In certain embodiments, the polar group in the dispersant is nitrogen or oxygen-derived. Nitrogen-based dispersants are typically derived from amines. The amines from which the nitrogen-based dispersants are derived are often polyalkylenepolyamines, such as, for example, diethylenetriamine and trethylenetetramine. Amine-derived dispersants are also called nitrogen- or amine-dispersants, while those derived from alcohol are also called oxygen or ester dispersants. Oxygen-based dispersants can be neutral and the amine-based dispersants can be basic.

Non-limiting examples of suitable dispersants include substituted or unsubstituted alkenyl succinimide, an alkenyl succinimide derived by post-treatment with ethylene carbonate or boric acid, a succiamide, succinate esters, succinate ester-amide, pentaerythritol, phenate-salicylate or an analog thereof, an alkali metal or mixed alkali metal salt thereof, a polyamide ashless dispersant, a benzylamine, a Mannich type dispersant, a phosphorus-containing dispersant, or a combination thereof, in addition to the borate and borate ester disclosed above. As is further disclosed above, the borate can comprise an alkali metal borate or an alkaline earth metal borate, or a combination thereof. A dispersion of the alkali metal borate and/or the alkaline earth metal borate may be used.

Representative polymeric dispersants include poly(styrene-co-lauryl methacrylate-co-sulfoethyl methacrylate), poly(vinyltoluene-co-lauryl methacrylate-co-lithium methacrylate), poly(vinyltoluene-co-lauryl methacrylate-co-lithium methacrylate), poly(styrene-co-lauryl methacrylate-co-lithium methacrylate), poly(t-butylstyrene-co-styrene-co-lithium sulfoethyl methacrylate), poly(t-butylstyrene-co-lauryl methacrylate-co-lithium methacrylate), poly(t-butylstyrene-co-lithium methacrylate), poly(t-butylstyrene-co-lauryl methacrylate-co-lithium methacrylate-co-methacrylic acid), and poly(vinyltoluene-co-lauryl methacrylate-co-methacryloyloxyethyltrimethylammonium p-toluenesulfonate).

In an embodiment the dispersant is a polyester dispersant. The dispersant PERFAD 3000 (Croda, Inc., Edison, N.J.) is specifically mentioned.

The dispersant may be contained in an amount of 0.01 wt % to about 10 wt %, specifically 0.05 wt % to 7 wt %, more specifically 0.1 wt % to 4 wt %, based on the total weight of the lubricant additive composition. Some suitable dispersants have been described in Mortier et al., "Chemistry and Technology of Lubricants," 2nd Edition, London, Springer, Chapter 3, pages 86-90 (1996); and Leslie R. Rudnick, "Lubricant additive compositions: Chemistry and Applications," New York, Marcel Dekker, Chapter 5, pages 137-170 (2003), both of which are incorporated herein by reference in their entirety.

The lubricant additive composition can further comprise an additional chemical agent or other type of material to impart additional desired properties, e.g. a friction reducing agent, anti-wear or extreme-pressure agent, anti-corrosion agent, detergent, antioxidant, suspension agent, thixotropic agent, pour point depressant, or metal deactivator other than as provided above to provide a lubricant additive composition suitable for use in a particular application.

The anti-wear additive (e.g., extreme pressure) can deposit a surface film to reduce wear. Extreme pressure additives can also react with a surface to reduce or prevent scuffing, galling, or seizure. As used herein, anti-wear additives include extreme pressure additives.

The anti-wear agent may be an organoboron anti-wear agent which comprises boron, and may comprise a borate ester in addition to the borate ester disclosed above, a boric acid, a borated epoxide, boron nitride, or a combination thereof. The organoboron anti-wear agent is hydrolytically stable and provides improved anti-wear, anti-weld, extreme pressure, and/or friction properties and may also provide rust and corrosion inhibition for bearings and other metal engine components.

Examples of other suitable anti-wear agents include a phosphate ester, sulfurized olefin, a sulfur-containing anti-wear additive including a metal dihydrocarbyldithiophosphate (such as a zinc dialkyldithiophosphate), a thiocarbamate-containing compound including a thiocarbamate ester, an alkylene-coupled thiocarbamate, or a bis(S-alkyldithiocarbamyl) disulfide. The dithiocarbamate-containing compound may be prepared by reacting a dithiocarbamate acid or salt with an unsaturated compound. The dithiocarbamate containing compound may also be prepared by simultaneously reacting an amine, carbon disulfide and an unsaturated compound. Dithiocarbamate compounds are described in U.S. Pat. Nos. 4,758,362 and 4,997,969, the contents of which are incorporated herein by reference in their entirety.

The lubricant additive composition may also comprise an ashless anti-wear agent, such as a monoester of a polyol and an aliphatic carboxylic acid, such as a C12 to C24 aliphatic carboxylic acid. The monoester of the polyol and the aliphatic carboxylic acid may be in the form of a mixture with an oil such as sunflower oil, or the like, which may be present in the ashless anti-wear agent mixture. Representative polyols include ethylene glycol, propylene glycol, glycerol, butanediol, hexanediol, sorbitol, arabitol, mannitol, sucrose, fructose, glucose, cyclohexane diol, erythritol, or pentaerythritol. Examples of the carboxylic acid include dodecanoic acid, stearic acid, lauric acid, behenic acid, and oleic acid.

The lubricant additive composition may also comprise a fluoride anti-wear agent. Representative fluoride anti-wear agents include lithium fluoride (LiF), sodium fluoride (NaF), potassium fluoride (KF), rubidium fluoride (RbF), cesium fluoride (CsF), magnesium fluoride ($MgF_2$), calcium fluoride ($CaF_2$), strontium fluoride ($SrF_2$), yttrium fluoride ($YF_3$), lanthanum fluoride ($LaF_3$), cerium fluoride ($CeF_3$), neodymium fluoride ($NdF_3$), europium fluoride ($EuF_3$), dysprosium fluoride ($DyF_3$), or a combination thereof.

The anti-wear agent may be contained in an amount of 1 to 60 wt %, specifically 3 to 50 wt %, more specifically 5 to 40 wt %, based on the total weight of the lubricant additive composition.

A combination comprising one or more of the foregoing anti-wear agents can be used. An embodiment comprising a first anti-wear agent and a second anti-wear agent, wherein the first anti-wear agent is an organoboron anti-wear agent different from the borate ester and the second anti-wear agent is $LaF_3$, is specifically mentioned.

The lubricant additive composition may further comprise a suspension agent, e.g., a thixotropic material, which may be included to uniformly suspend the components of the lubricant additive composition. Suitable suspension agents include, without limitation, silica, clay, organic thickeners, or mixtures thereof. Suitable organic thickeners can include, without limitation, a metal or mineral soap or complex soap, a polyurea, another polymer, or a combination thereof. Representative soaps or soap complexes include an aluminum benzoate-stearate complex, an aluminum benzoate-behenate-arachidate complex, a lithium azelate-stearate complex, a lithium sebecate-stearate or behenate complex, a lithium adipate-stearate complex, a calcium acetate-stearate complex, and a calcium sulfonate-stearate complex. Other aluminum, calcium, lithium, or other mineral soaps or complex soaps and combinations thereof can equally well be used.

The thixotropic agent can include, without limitation, a polyalphaolefin, polybutene, polyolester, vegetable oil, animal oil, another essential oil, or a combination thereof. The polyalphaolefin (PAO) can include, without limitation, a polyethylene, polypropylene, polybutene, polypentene, polyhexene, polyheptene, a higher PAO, a copolymer thereof, or a combination thereof. PAOs sold by ExxonMobil Chemical Company as SHF fluids and PAOs sold by BP-Amoco Chemical under the name Durasyn are specifically mentioned. Suitable polybutenes include, without limitation, those sold by BP Amoco Chemical Company and ExxonMobil Chemical Company under the trade names INDOPOL and PARAPOL, respectively. BP Amoco's INDOPOL 100 is specifically mentioned. A representative polyolester includes, without limitation, a neopentyl glycol, a trimethylolpropane, a pentaerythriol, a dipentaerythritol, a diester such as dioctylsebacate (DOS), diactylazelate (DOZ), or dioctyladipate. A suitable petroleum based fluid includes, without limitation, white mineral oil, a paraffinic oil, or a naphthenic oil having a viscosity of 5 to 600 centistokes at 40° C. A suitable vegetable oil includes, without limitation, castor oil, corn oil, olive oil, sunflower oil, sesame oil, peanut oil, another vegetable oil, a modified vegetable oil such as a cross-linked castor oil, or a combination thereof. Other essential oils will work as well. A combination comprising at least one of the above identified oils can be used.

The suspension agent can be used in an amount sufficient to provide a suitable viscosity and other suspension properties. The amount of the suspension agent may be 0.01 to 10 wt %, specifically 0.05 to 7 wt %, more specifically 0.1 to 4 wt %, based on the total weight of the lubricant additive composition.

The lubricant additive composition disclosed herein can optionally comprise a friction modifier that can further improve the friction between moving parts. The friction modifier can be a long-chain molecule with a polar end group and a nonpolar linear hydrocarbon chain. The polar end group can either physically adsorb onto the metal surface or chemically react with it, while the hydrocarbon chain can extend into the lubricant. The chains associate with one another and the lubricant to form a strong lubricant film.

Non-limiting examples of suitable friction modifiers include a fatty carboxylic acid; a derivative (e.g., alcohol, ester, borated ester, amide, or metal salt) of a fatty carboxylic acid; a mono-, di-, or tri-alkyl substituted phosphoric acid or phosphonic acid; a derivative (e.g., ester, amide, or metal salt) of mono-, di-, or tri-alkyl substituted phosphoric acid or phosphonic acid; a mono-, di-, or tri-alkyl substituted amine; mono- or di-alkyl substituted amide, or a combination thereof.

In an embodiment, the friction modifier is a saturated C13 to C18 fatty acid. The amount of the friction modifier may be 0.01 to 10 wt %, specifically 0.05 to 5 wt %, more specifically 0.1 to 3 wt %, based on the total weight of the lubricant additive composition. Some suitable friction modifiers have been described in Mortier et al., "Chemistry and Technology of Lubricants," 2nd Edition, London, Springer, Chapter 6, pages 183-187 (1996); and Leslie R. Rudnick, "Lubricant additive compositions: Chemistry and Applications," New York, Marcel Dekker, Chapters 6 and 7, pages 171-222 (2003), both of which are incorporated herein by reference in their entirety.

The lubricant additive composition can optionally comprise a pour point depressant that can lower the pour point of the lubricant additive composition. In an embodiment the pour point depressant possess a polymeric structure; a waxy and non-waxy component; a comb structure comprising a short backbone with long pendant groups; a broad molecular weight distribution; or a combination thereof. Non-limiting examples of suitable pour point depressants include a polymethacrylate, an alkyl acrylate polymer, an alkyl methacrylate polymer, an alkyl fumarate polymer, a di(tetra-paraffin phenol)phthalate, a condensate of tetra-paraffin phenol, a condensate of a chlorinated paraffin with naphthalene, an alkylated naphthalene, a styrene ester, an oligomerized alkyl phenol, a phthalic acid ester, an ethylene-vinyl acetate copolymer, or a combination thereof. In an embodiment the pour point depressant is a tetra (long-chain) alkyl silicate, phenyltrstearyloxysilane, or a pentaerythritol tetrastearate. In an embodiment, the pour point depressant comprises an ethylene-vinyl acetate copolymer, a condensate of chlorinated paraffin and phenol, polyalkyl styrene, or a combination thereof. The amount of the pour point depressant may be 0.01 to 10 wt %, specifically 0.05 to 5 wt %, more specifically 0.1 to 3 wt %, based on the total weight of the lubricant additive composition. Some suitable pour point depressants have been described in Mortier et al., "Chemistry and Technology of Lubricants," 2nd Edition, London, Springer, Chapter 6, pages 187-189 (1996); and Leslie R. Rudnick, "Lubricant additive compositions: Chemistry and Applications," New York, Marcel Dekker, Chapter 11, pages 329-354 (2003), both of which are incorporated herein by reference in their entirety.

The lubricant additive composition can optionally comprise a foam inhibitor or an anti-foam agent that can break up a foam in a lubricant. Non-limiting examples of suitable anti-foam agents include a silicone oil or a polydimethylsiloxane, a fluorosilicone, an alkoxylated aliphatic acid, a polyether (e.g., polyethylene glycol), a branched polyvinyl ether, an alkyl acrylate polymer, an alkyl methacrylate polymer, a polyalkoxyamine, or a combination thereof. In an embodiment, the anti-foam agent comprises glycerol monostearate, polyglycol palmitate, a trialkyl monothiophosphate, an ester of sulfonated ricinoleic acid, benzoylacetone, methyl salicylate, glycerol monooleate, or glycerol dioleate. The amount of the anti-foam may be 0.01 to 5 wt %, specifically 0.05 to 3 wt %, more specifically 0.1 to 1 wt %, based on the total weight of the lubricant additive composition. Some suitable anti-foam agents have been described in Mortier et al., "Chemistry and Technology of Lubricants," 2nd Edition, London, Springer, Chapter 6, pages 190-193 (1996), which is incorporated herein by reference in their entirety.

In an embodiment, the lubricant additive composition comprises a metal deactivator, e.g., a compound which reduces the activity of the metal. Some non-limiting examples of suitable metal deactivators include disalicylidene propylenediamine, a triazole, a thiadiazole, or a mercaptobenzimidazole.

Optionally, the lubricant additive composition can further comprise an antioxidant effective to reduce or prevent the oxidation of the base oil. Examples of the anti-oxidants include, but are not limited to, a phenol type (phenolic) oxidation inhibitor, such as 4,4'-methylene bis(2,6-di tert butylphenol), 4,4'-bis(2,6-di tert-butylphenol), 4,4'-bis(2 methyl 6 tert butylphenol), 2,2'-methylene bis(4-methyl 6 tert butylphenol), 4,4'-butylidene bis(3 methyl 6 tert butylphenol), 4,4'-isopropylidene bis(2,6 di tert butylphenol), 2,2'-methylene bis(4-methyl 6 nonylphenol), 2,2'-isobutylidene bis(4,6 dimethylphenol), 2,2'-5 methylene bis(4 methyl 6 cyclohexylphenol), 2,6-di tert butyl 4-methylphenol, 2,6-di tert butyl 4 ethylphenol, 2,4-dimethyl 6 tert butyl-phenol, 2,6-di tert 1 dimethylamino p cresol, 2,6-di tert 4 (N,N'-dimethylaminomethylphenol), 4,4'-thiobis(2 methyl 6 tert butylphenol), 2,2'-thiobis(4 methyl 6 tert butylphenol), bis(3 methyl 4 hydroxy 5 tert-10 butylbenzyl)sulfide, bis(3,5 di tert butyl 4 hydroxybenzyl), or a combination thereof. Diphenylamine type oxidation inhibitors include, but are not limited to, alkylated diphenylamine, phenyl alpha naphthylamine, and alkylated alpha naphthylamine, sulfur-based antioxidants (e.g., dilauryl-3,3'-thiodipropionate or a sulfurized phenolic antioxidant), a phosphorous-containing antioxidant (e.g., a phosphites), a zinc dithiophosphate, an oil-soluble copper compound, or a combinations thereof. Other types of oxidation inhibitors include metal dithiocarbamate (e.g., zinc dithiocarbamate), and 15 methylenebis (dibutyldithiocarbamate). The amount of the antioxidant may be 0.01 to 10 wt %, specifically 0.05 to 5 wt %, more specifically 0.1 to 3 wt %, based on the total weight of the lubricant additive composition. Some suitable antioxidants have been described in Leslie R. Rudnick, "Lubricant additive compositions: Chemistry and Applications," New York, Marcel Dekker, Chapter 1, pages 1-28 (2003), which is incorporated herein by reference in their entirety.

The lubricant additive composition can further comprise a rust inhibitor. The rust inhibitor can attach onto a metal surface to form an impenetrable protective film, and can be physically or chemically adsorbed to the surface. Specifically, and while not wanting to be bound by theory, it is understood that film formation can occurs when the additive interacts with the metal surface via a polar group and associates with the lubricant (e.g., base oil) via a nonpolar group. Suitable rust inhibitors may include, for example, various nonionic polyoxyethylene surface active agents such as polyoxyethylene lauryl ether, polyoxyethylene higher alcohol ether, polyoxyethylene nonylphenyl ether, polyoxyethylene octylphenyl ether, polyoxyethylene octyl stearyl ether, polyoxyethylene oleyl ether, polyoxyethylene sorbitol monostearate, polyoxyethylene sorbitol mono-oleate, and polyethylene glycol monooleate. Suitable rust inhibitors may further include other compounds such as, for example, a monocarboxylic acid (e.g., 2-ethylhexanoic acid, lauric acid, myristic acid, palmitic acid, oleic acid, linoleic acid, linolenic acid, behenic acid, or cerotic acid), an oil-soluble polycarboxylic acid (e.g., those produced from a fatty acids, oleic acid, or linoleic acid), an alkenylsuccinic acid in which the alkenyl group contains 10 or more carbon atoms (e.g., tetrapropenylsuccinic acid, tetradecenylsuccinic acid, or hexadecenylsuccinic acid); a long-chain alpha,omega-dicarboxylic acids having a molecular weight in the range of 600 to 3000 daltons, or a combination thereof. Further examples of rust agents include a metal soap, a fatty acid amine salt, a metal salt of a sulfonic acid, partial carboxylic acid ester of polyhydric alcohol, or a phosphoric ester.

The amount of the rust inhibitor may be 0.01 to 10 wt %, specifically 0.05 to 5 wt %, more specifically 0.1 to 3 wt %, based on the total weight of the lubricant additive composition.

The lubricant additive composition can have a pour point of −60° C. to 0° C.; specifically −55° C. to −10° C.; more specifically −50° C. to −20° C. The lubricant additive composition can have a shear stability index (SSI) of 2 to 50, specifically 3 to 45, more specifically 4 to 40, when determined according to ASTM 3945, wherein lower values signify that a material is more shear stable.

The lubricant additive composition may have a Brookfield viscosity of 10,000 to 1,000,000 centipoise (cP), specifically 20,000 to 500,000 cP, more specifically 30,000 to 250,000 cP.

In an embodiment, the lubricant additive composition can have a low temperature viscosity when determined with a Mini Rotary Viscometer (MRV) at −25° C. of 5,000 to 25,000 cP, specifically 6,000 to 20,000 cP, more specifically 8,000 to 19,000 cP.

The lubricant additive composition may be combined with an additional quantity of a base oil to provide a lubricant. The base oil is disclosed above and the foregoing disclosure is not repeated for clarity. The lubricant additive composition and the base oil may be combined in a weight ratio of 1:1 to 1:1000, specifically 1:2 to 1:500, more specifically 1:3 to 1:250, or 1:4 to 1:125. Also, the lubricant additive composition and the base oil may be combined in a volume ratio of 1:1 to 1:1000, specifically 1:2 to 1:500, more specifically 1:3 to 1:250, or 1:4 to 1:125. An embodiment wherein the lubricant additive composition and the base oil are combined in a volume ratio of 1:32 is specifically mentioned.

A method of manufacturing the lubricant additive composition comprises: contacting a borate comprising an alkali metal borate, an alkaline earth metal borate, or a combination thereof; tungsten disulfide having a diameter of 4 to 160 nanometers; and a base oil under conditions effective to disperse the borate and the tungsten disulfide to manufacture the lubricant additive composition.

In another embodiment, a method of manufacturing the lubricant additive composition comprises contacting a borate comprising an alkali metal borate, an alkaline earth metal borate, or a combination thereof, tungsten disulfide having a diameter of 4 to 160 nanometers, a borate ester, an anti-scuff agent comprising a metal dithiocarbamate, a metal dialkyldithiocarbamate, a metal dithiophosphate, a metal dialkyldithiophosphate, or a combination thereof; and a base oil under conditions effective to disperse the borate, the tungsten disulfide, the borate ester, and the anti-scuff agent in the base oil to manufacture the lubricant additive composition. The borate, the tungsten disulfide, the borate ester, the anti-scuff agent, and the base oil are further disclosed above. An embodiment in which the borate is potassium borate, the tungsten disulfide is inorganic fullerene tungsten disulfide, the borate ester is triisopropylamine borate, the anti-scuff agent is antimony dithiocarbamate, and the base oil is a polyalphaolefin is specifically mentioned.

The dispersion may be provided by mixing, blending, or otherwise combining the borate, the tungsten disulfide, if present the borate ester and the anti-scuff agent, and the base oil. The contacting may comprise mixing in a suitable mixer, such as a ball mill, a colloid mill, an ultrasonic mixer, a planetary mixer, a Hobart® mixer, a Henschel mixer, a KADY mill, or a SONOLATOR. In a mixer with rotary action, such as a planetary mixer or a KADY mill, the mixing may be at a suitable rate, such as at 2000 to 12000 revolutions per minute (RPM), specifically 2500 to 10000 RPM, more specifically 3000 to 9000 RPM. If an ultrasonic mixer such as a SONOLATOR is used, mixing can be at a suitable energy, such as a setting of 4 to 6, specifically a setting of 5 on a SONOLATOR mixer provided by Sonic Corporation of Stratford, Conn. The contacting may be conducted for a suitable time, specifically 0.01 to 10 hours, specifically 0.1 to 8 hours, more specifically 0.3 to 4 hours, and at a suitable temperature, specifically 25 to 150° C., specifically 30 to 125° C., more specifically 35 to 100° C.

The contacting may be conducted in a single step, or may be performed in multiple steps. When the contacting is conducted in multiple steps, a suitable combination of speeds, times, and temperatures may be used. In an embodiment the contacting may comprise blending at least one of the borate, the tungsten disulfide, the borate ester, the anti-scuff agent, and the base oil. The blending may include low shear conditions. The blending may comprise blending in a rotary mixer such as a planetary mixer, a Hobart® mixer, a Henschel mixer, a KADY mill, or a DayMax® mixer at 200 to 3000 RPM, specifically 300 to 2500 RPM for 1 to 60 minutes, specifically 5 to 50 minutes. An embodiment in which the borate, the tungsten disulfide, the borate ester, the anti-scuff agent, and the base oil are first blended in a KADY mill at 500 to 1500 RPM is specifically mentioned. In another embodiment, the borate, the tungsten disulfide, and the base oil are first blended. The blending may be conducted until a temperature of the mixture is 50° C. to 150° C., specifically 75° C. to 125° C.

The contacting may comprise ultrasonically mixing at least one of the borate, the tungsten disulfide, the borate ester, the anti-scuff agent, and the base oil. A representative ultrasonic mixer is a SONOLATOR. The ultrasonically mixing may be conducted for 1 to 100 minutes, specifically 5 to 80 minutes, more specifically 10 to 60 minutes. A temperature of the mixture during the ultrasonic mixing may be 20° C. to 200° C., specifically 30° C. to 180° C., more specifically 40° C. to 160° C. The ultrasonically mixing may be conducted before or after the blending.

The contacting may also comprise high-shear mixing at least one of the borate, the tungsten disulfide, the borate ester, the anti-scuff agent, and the base oil. The high-shear may comprise mixing with a KADY mill or a DAYMAX mixer, for example, at 2000 to 12000 RPM, specifically 2500 to 10000 RPM, and for 1 to 100 minutes, specifically 5 to 80 minutes. A temperature of the mixture during the high-shear mixing may be 20° C. to 200° C., specifically 30° C. to 180° C., more specifically 40° C. to 160° C. An embodiment in which the temperature of the mixture is 80° C. to 120° C. during the high-shear mixing is specifically mentioned. The high-shear mixing may be conducted before or after the ultrasonic mixing. An embodiment in which the borate, the tungsten disulfide, the borate ester, the anti-scuff agent, and the base oil are first ultrasonically mixed, and then high-shear mixed is specifically mentioned. In an embodiment, the borate, the tungsten disulfide, and the base oil are ultrasonically mixed with a SONOLATOR, and then the ultrasonically mixed borate ester, anti-scuff agent, and base oil are high-shear mixed with the anti-scuff agent and the borate ester to form the lubricant additive composition.

Alternatively, a dispersion of the tungsten disulfide in a base oil may be used. A suitable dispersion of the tungsten disulfide may be provided by adding the tungsten disulfide to the base oil while blending. Ultrasonically mixing, or high-shear mixing may be used. In an embodiment, the tungsten disulfide and a polyalphaolefin having a viscosity of 4 centistokes at 100° C. are high-shear mixed, e.g., mixed in SONOLATOR or in a KADY mill, e.g., at 8000 RPM, to provide a tungsten disulfide dispersion in the polyalphaolefin. The dispersion of the tungsten disulfide may then be contacted with the borate ester, the anti-scuff agent, and the borate, e.g., a dispersion of the borate in the base oil, to provide the lubricant additive. The contacting may include ultrasonically mixing, high-shear mixing, or a combination thereof.

Alternatively, a dispersion of the borate in a base oil may be used. A suitable dispersion of the borate may be provided by contacting the borate and the base oil. The contacting may comprise at least one of blending, ultrasonically mixing, or high-shear mixing as disclosed above. In an embodiment, potassium borate and a polyalphaolefin having a viscosity of 4 centistokes at 100° C. are high-shear mixed, e.g., mixed in a KADY mill at 8000 RPM, to provide a potassium borate dispersion in polyalphaolefin. A representative dispersion of a borate is product BD 908 available from DRD Additives LLC of Belvidere, Ill. The dispersion of the borate may then be contacted with the tungsten disulfide and an additional quantity of a base oil, wherein the contacting may include ultrasonically mixing. The ultrasonically mixed borate and tungsten disulfide my then be further combined with the anti-scuff agent and the borate ester, wherein the further combining may include ultrasonically mixing, high-shear mixing, or a combination thereof.

The contacting may include conditions effective to form a colloid. A colloid is a stable system of a plurality of phases, one of which is dispersed in the other. In an embodiment, the resulting combination is substantially or effectively stable to settling, that is at least a portion of the borate and the tungsten disulfide is effectively suspended effectively indefinitely and does not settle. In an embodiment, the borate and the tungsten disulfide are suspended effectively indefinitely and do not settle.

The combination of the borate, the tungsten disulfide, the anti-scuff agent, and the borate ester in the base oil may be optionally settled by allowing the combination to stand unagitated. The settling can be an effective means to remove particles that cannot be suitably dispersed, for example particles having an undesirably large particle size. The settling may be conducted for 1 to 48 hours, specifically 2 to 24 hours, more specifically 3 to 12 hours.

Also, the combination of the borate, the tungsten disulfide, the anti-scuff agent, and the borate ester in the base oil may be optionally filtered, either before or after the settling, or both. The filtering may be performed by passing the combination through a filter. The filter may have a maximum pore size of 10 micrometers (μm), specifically 1 μm, more specifically 0.5 μm.

The combination of the borate, the tungsten disulfide, the anti-scuff agent, and the borate ester in the base oil may be combined with another agent or material, e.g. a friction reducing agent, anti-wear or extreme-pressure agent, anti-corrosion agent, detergent, antioxidant, suspension agent, thixotropic agent, pour point depressant, or metal deactivator if desired.

In an embodiment the lubricant additive composition can be used either alone or in conjunction with an additional base oil to provide a lubricant. The base oil used to provide the lubricant additive composition may be the same or different than the additional base oil. Thus in an embodiment, the lubricant additive composition may comprise a first base oil, and the lubricant additive composition may be combined with a second base oil to provide a lubricant, wherein the first and second base oils are independently selected. The base oil is further disclosed above. In an embodiment, the lubricant additive composition can be combined with a synthetic or natural oil to provide an engine lubricant. A method of lubricating an engine includes contacting the lubricant additive composition with an engine to lubricate the engine. The lubricant additive composition may be suitable for use in an engine as a component of the motor oil. Also, the lubricant additive composition can be disposed on a surface, such as a surface of an axel or a bearing, to provide desirable lubricating properties.

In another embodiment, the lubricant additive composition can be used as a restorative or cleaning agent. It has been surprising observed that when an engine containing the lubricant additive composition is operated, the components of the engine are polished and surface blemishes or imperfections, such as pits, are removed from the surfaces of moving parts of the engine. In addition, parts treated with the lubricant additive composition are surprisingly free of debris or other build-up after operation of the engine treated with the lubricant additive composition. While not wanting to be bound by theory, it is understood that the lubricant additive composition provides this surprising effect by forming a hard and smooth microscopic coating on the surface of the moving parts and by sequestering or suspending materials which would otherwise form a deposit on the engine components. Also, it is understood that because the lubricant additive composition provides a surface which is microscopically smooth, debris cannot adhere to the surfaces of the engine components after treatment. Such treatment can include contacting the surface with the lubricant additive composition, e.g., by adding the lubricant additive composition to the engine oil, and moving the surface, e.g., by operating the engine.

Specifically, a surface of a component treated with the lubricant additive composition (e.g., a restored surface) can have an arithmetic mean surface roughness Ra of less than 0.3 μm, specifically less than 0.2 μm, more specifically less than 0.1 μm. In an embodiment the surface roughness Ra of a component treated with the lubricant additive composition is 0.01 to 0.3 μm, specifically 0.2 to 3 μm.

In another embodiment, the composition is useful as a polish. The polish can effectively remove surface irregularities. Further, the polish can provide a shiny surface. A method of polishing includes contacting a surface with the lubricant additive composition, and moving the contacted surface against another surface. Representative surfaces that can be polished by the polish include a metal, glass, or plastic surface.

EXAMPLES

Example 1

5 grams (g) of potassium borate (Rose Mill Co., West Hartford, Conn.) was added to 3.78 liters of polyalphaolefin (DRD Additives LLC, product BD 2003). The potassium borate and polyalphaolefin were blended using an electric hand mixer for 20 minutes and then mixed with a high-shear mixer at 18,000 revolutions per minute (RPM) to provide a potassium borate dispersion. 0.95 liters of the potassium borate dispersion, 5 g of inorganic-fullerene tungsten disulfide (ApNano Materials, Inc, New York, N.Y., product NanoLub RL, particle size less than 50 nm), 0.95 liters of a solution of antimony dialkyldithiocarbamate (Tiarco Chemical, Octopol AD), and 0.95 liters of a borate ester solution (R.T. Vanderbilt Co., Inc., Norwalk, Conn., product Vanlube® 289) were combined and mixed using a DayMax at 8000 RPM for 1 hour to provide a lubricant additive.

Example 2

A dispersion of inorganic-fullerene tungsten disulfide in polyalphaolefin was prepared by slowly adding 2 g of inorganic-fullerene tungsten disulfide (ApNano Materials, Inc, New York, N.Y., product NanoLub RL, particle size less than 50 nm) to 0.47 liters of polyalphaolefin (DRD Additives LLC, product BD 2003) while blending with a 1 horsepower hand blender, and then blending for 20 minutes to provide a tungsten disulfide dispersion. A dispersion of potassium borate in polyalphaolefin was prepared by mixing 5 g of potassium borate (Rose Mill Co., West Hartford, Conn., particle size less than 50 nm) and 3.78 liters of polyalphaolefin (DRD Additives LLC, product BD 2003). The tungsten disulfide dispersion, 0.95 liters of a borate ester solution (R.T. Vanderbilt Co., Inc., Norwalk, Conn., product Vanlube® 289), 0.47 liters of a solution of antimony dialkyldithiocarbamate (Tiarco Chemical, Octopol AD), and 1.89 liters of the dispersion of potassium borate in polyalphaolefin were mixed in a KADY mill for 20 minutes at 8000 RPM. The mixture was then ultrasonically treated in a SONOLATOR at a setting of 5, and then mixed in the KADY mill at 8000 RPM for 1 hour during which time the temperature of the mixture was 90° C. The mixture was then left to stand for 4 hours to produce the lubricant additive.

Example 3

The lubricant additive composition of Example 2 was evaluated in accordance with SAE J1321 October 1986 "Fuel Consumption Test Procedure—Type II," the contents of which in its entirety are herein incorporated by reference. The test was conducted with three 2012 Freightliner Cascadia trucks, one designated a control truck and the other two designated test trucks, each equipped with a 53 foot box van ballasted to 75,000 pounds and using Shell Rotella T3 as the engine oil. In accordance with the J1321 procedure, all three trucks were first driven in a baseline segment. Then two quarts of engine oil were removed from each of the two test trucks to make room for the lubricant additive composition and two quarts of the lubricant additive composition of Example 2 added to provide a proper oil level in each engine. After addition of the lubricant additive composition, each truck was driven in a test segment in accordance with the J1321 procedure. The results are summarized in Table 1. In Table 1, the percent fuel saved and percent improvement are relative to the baseline segment.

TABLE 1

| | Test Truck 1 | Test Truck 2 |
|---|---|---|
| Percent fuel saved | 2.28% | 1.33% |
| Percent Improvement | 2.33% | 1.35% |

As shown in Table 1, use of the lubricant additive composition in the test trucks provided a surprising improvement in fuel economy.

Example 4

The lubricant additive composition of Example 2 was evaluated in a 2010 Jeep Wrangler by adding 5 fluid ounces to the engine oil. Prior to addition of the lubricant additive composition, the Jeep Wrangler had an average fuel economy of 20.87 miles per gallon over 21,042 miles. After addition of the lubricant additive composition the average fuel economy was 21.87 miles per gallon over 1,822 miles. Surprisingly, when added to a Jeep Wrangler, a 4.85 mile per gallon improvement in fuel economy was provided.

Prophetic Example 1 g of lubricant additive of Example 2 will be added to 99 g of polyalphaolefin (DRD Additives product BD 2003) and the mixture will be blended with a rotary mixer. The mixture will have properties suitable for dispensing with a spray bottle.

It is known that some of the materials described above may interact in the final formulation, so that the components of the final formulation may be different from those that are initially added. For instance, metal ions (of, e.g., a detergent) can migrate to other acidic or anionic sites of other molecules. The products formed thereby, including the products formed upon employing the lubricant additive composition in its intended use, may not be susceptible of easy description. Nevertheless, all such modifications and reaction products are included within the scope of the present disclosure; and the present disclosure encompasses a composition prepared by admixing the components disclosed above.

This invention may be embodied in many different forms, and should not be construed as limited to the embodiments set forth herein. Rather, these embodiments are provided so that this disclosure will be thorough and complete, and will fully convey the scope of the invention to those skilled in the art.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an" and "the" are intended to include the plural forms as well, unless the context clearly indicates otherwise. "Or" includes "and/or." It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Unless otherwise specified, diameters are determined using dynamic light scattering and refer to a particle diameter.

"Group" means a group of the Periodic Table of the Elements according to the International Union of Pure and Applied Chemistry ("IUPAC") Group 1-18 group classification system.

"Alkyl" means a straight or branched chain, saturated, monovalent hydrocarbon group (e.g., methyl or hexyl).

"Alkenyl" means a straight or branched chain, monovalent hydrocarbon group having at least one carbon-carbon double bond (e.g., ethenyl ($—HC{=}CH_2$)).

"Alkynyl" means a straight or branched chain, monovalent hydrocarbon group having at least one carbon-carbon triple bond (e.g., ethynyl).

"Aryl" means a monovalent group formed by the removal of one hydrogen atom from one or more rings of an arene (e.g., phenyl or napthyl).

"Arylalkyl" means a substituted or unsubstituted aryl group covalently linked to an alkyl group that is linked to a compound (e.g., a benzyl is a C7 arylalkyl group).

"Alkoxy" means an alkyl group that is linked via an oxygen (i.e., alkyl-O—), for example methoxy, ethoxy, and sec-butyloxy groups.

"Cycloalkyl" means a monovalent group having one or more saturated rings in which all ring members are carbon (e.g., cyclopentyl and cyclohexyl).

"Cycloalkenyl" means a monovalent group having one or more rings and one or more carbon-carbon double bond in the ring, wherein all ring members are carbon (e.g., cyclopentyl and cyclohexyl).

The prefix "hetero" means that the compound or group includes at least one ring that is a heteroatom (e.g., 1, 2, or 3 heteroatom(s)), wherein the heteroatom(s) is each independently N, O, S, Si, or P.

A "hydrocarbyl group" as used herein means a group having an appropriate valence in view of the number of substitutions shown in the structure. Hydrocarbyl groups contain at least carbon and hydrogen, and can optionally contain 1 or more (e.g., 1-8) heteroatoms selected from N, O, S, Si, P, or a combination thereof. Hydrocarbyl groups can be unsubstituted or substituted with one or more substituent groups up to the valence allowed by the hydrocarbyl group independently selected from a C1-30 alkyl, C2-30 alkenyl, C2-30 alkynyl, C6-30 aryl, C7-30 arylalkyl, C1-12 alkoxy, C1-30 heteroalkyl, C3-30 heteroarylalkyl, C3-30 cycloalkyl, C3-15 cycloalkenyl, C6-30 cycloalkynyl, C2-30 heterocycloalkyl, halogen (e.g., F, C1, Br, or I), hydroxy, nitro, cyano, amino, azido, amidino, hydrazino, hydrazono, carbonyl, carbamyl, thiol, carboxy (C1-6 alkyl) ester, carboxylic acid, carboxylic acid salt, sulfonic acid or a salt thereof, and phosphoric acid or a salt thereof.

"Substituted" means that the compound or group is substituted with at least one (e.g., 1, 2, 3, or 4) substituent independently selected from a hydroxyl (—OH), a C1-9 alkoxy, a C1-9 haloalkoxy, an oxo (=O), a nitro ($—NO_2$), a cyano (—CN), an amino ($—NH_2$), an azido ($—N_3$), an amidino ($—C({=}NH)NH_2$), a hydrazino ($—NHNH_2$), a hydrazono ($—C({=}NNH_2)—$), a carbonyl (—C(=O)—), a carbamoyl group ($—C(O)NH_2$), a sulfonyl ($—S({=}O)_2—$), a thiol (—SH), a thiocyano (—SCN), a tosyl ($CH_3C_6H_4SO_2—$), a carboxylic acid (—C(=O)OH), a carboxylic C1 to C6 alkyl ester (—C(=O)OR wherein R is a C1 to C6 alkyl group), a carboxylic acid salt (—C(=O)OM) wherein M is an organic or inorganic anion, a sulfonic acid ($—SO_3H_2$), a sulfonic mono- or dibasic salt ($—SO_3MH$ or $—SO_3M_2$ wherein M is an organic or inorganic anion), a phosphoric acid ($—PO_3H_2$), a phosphoric acid mono- or dibasic salt ($—PO_3MH$ or $—PO_3M_2$ wherein M is an organic or inorganic anion), a C1 to C12 alkyl, a C3 to C12 cycloalkyl, a C2 to C12 alkenyl, a C5 to C12 cycloalkenyl, a C2 to C12 alkynyl, a C6 to C12 aryl, a C7 to C13 arylalkylene, a C4 to C12 heterocycloalkyl, and a C3 to C12 heteroaryl instead of hydrogen, provided that the substituted atom's normal valence is not exceeded.

As used herein, the term "fatty acid" means a carboxylic acid having the formula RCOOH. R represents an aliphatic group, preferably an alkyl group. R can comprise 4 or more carbon atoms. The fatty acid can be a C4 to C30 fatty acid, specifically a C6 to C20 fatty acid. In an embodiment, the fatty acid comprises 4 to 22 carbon atoms. Fatty acids can be saturated, monounsaturated, or polyunsaturated. In addition, fatty acids can comprise a straight or branched chain. The branched chains may have one or more points of branching. In addition, the branched chains may include cyclic branches.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A lubricant additive composition comprising:

a borate comprising an alkali metal borate, an alkaline earth metal borate, or a combination thereof;

tungsten disulfide comprising particles having a particle diameter of 4 to 160 nanometers;

an anti-scuff agent comprising a metal dithiocarbamate, a metal dialkyldithiocarbamate, a metal dithiophosphate, a metal dialkyldithiophosphate, or a combination thereof;

a borate ester; and a base oil.

2. The lubricant additive composition of claim 1, wherein the borate comprises a sodium borate, a potassium borate, a magnesium borate, a calcium borate, or a combination thereof.

3. The lubricant additive composition of claim 2, wherein the borate is a potassium borate.

4. The lubricant additive composition of claim 2, wherein the borate is contained in an amount of 0.0001 to 10 weight percent, based on a total weight of the lubricant additive composition.

5. The lubricant additive composition of claim 1, wherein the tungsten disulfide has a spherical shape and the tungsten disulfide is inorganic fullerene tungsten disulfide.

6. The lubricant additive composition of claim 5, wherein the tungsten disulfide comprises particles having a diameter of 8 to 80 nanometers.

7. The lubricant additive composition of claim 1, wherein the tungsten disulfide is contained in an amount of 0.00001 to 1 weight percent, based on a total weight of the lubricant additive composition.

8. The lubricant additive composition of claim 1, wherein a metal of the anti-scuff agent is zinc, antimony, lead, molybdenum, or a combination thereof.

9. The lubricant additive composition of claim 8, wherein the metal dialkyldithiocarbamate comprises antimony dipentyldithiocarbamate.

10. The lubricant additive composition of claim 8, wherein the metal dialkyldithiophosphate is an antimony dialkyldithiophosphate of Formula 2:

(2)

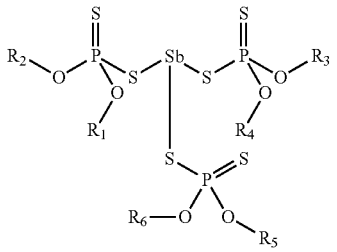

wherein in Formula 2, $R_1$, $R_2$, $R_3$, and $R_4$ are each independently hydrogen, a substituted or unsubstituted C1 to C20 alkyl group, a substituted or unsubstituted C6 to C26 cycloalkyl group, a substituted or unsubstituted C6 to C26 aryl group, a substituted or unsubstituted C6 to C26 alkylaryl group, or a substituted or unsubstituted C6 to C26 arylalkyl group.

11. The lubricant additive composition of claim 8, wherein the metal dialkyldithiocarbamate is an antimony dialkyldithiocarbamate of Formula 5:

(5)

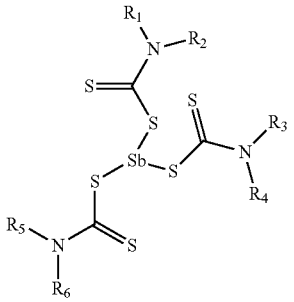

wherein in Formula 5, $R_1$, $R_2$, $R_3$, $R_4$, $R_5$ and $R_6$ are each independently hydrogen, a substituted or unsubstituted C1 to C20 alkyl group, a substituted or unsubstituted C6 to C26 cycloalkyl group, a substituted or unsubstituted C6 to C26 aryl group, a substituted or unsubstituted C6 to C26 alkylaryl group, or a substituted or unsubstituted C6 to C26 arylalkyl group.

12. The lubricant additive composition of claim 1, wherein the anti-scuff agent is contained in an amount of 0.0001 to 20 weight percent, based on a total weight of the lubricant additive composition.

13. The lubricant additive composition of claim 1, wherein the borate ester is a reaction product of a fatty oil, a dialkanolamine, and a boric acid.

14. The lubricant additive composition of claim 1, wherein the borate ester is according to Formula 8:

(8)

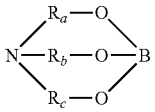

wherein in Formula 8, Ra, Rb, and Rc are each independently a substituted or unsubstituted C1 to C20 alkylene group, a substituted or unsubstituted C6 to C26 cycloalkylene group, a substituted or unsubstituted C6 to C26 arylene group, a substituted or unsubstituted C6 to C26 alkylarylene group, or a substituted or unsubstituted C6 to C26 arylalkylene group.

15. The lubricant additive composition of claim 14, wherein the borate ester is triisopropanolamine borate.

16. The lubricant additive composition of claim 1, wherein the borate ester is contained in an amount of 0.0001 to 20 weight percent, based on a total weight of the lubricant additive composition.

17. The lubricant additive composition of claim 1, further comprising diamond comprising particles having a particle diameter of 2 to 50 nanometers.

18. The lubricant additive composition of claim 17, wherein the diamond is contained in an amount of 0.0001 to 3 weight percent, based on a total weight of the lubricant additive composition.

19. The lubricant additive composition of claim 1, further comprising an organic tungsten composition.

20. The lubricant additive composition of claim 19, wherein the organic tungsten composition comprises an organic tungsten complex which is a reaction product of a tungsten salt, wherein the tungsten salt is a reaction product of an acidic tungsten and a nitrogeneous base, and a fatty acid compound.

21. The lubricant additive composition of claim 19, wherein the organic tungsten composition is contained in an amount of 0.001 to 10 weight percent, based on a total weight of the lubricant additive composition.

22. The lubricant additive composition of claim 1, wherein the borate is potassium borate;

the tungsten disulfide is inorganic fullerene tungsten disulfide and comprises particles having a particle diameter of 8 to 80 nanometers;

the metal dialkyldithiocarbamate, metal dialkyldithiophosphate, or combination thereof is antimony dipentyldithiocarbamate;

the borate ester is triisopropanolamine borate; and the base oil comprises a polyalphaolefin.

23. A lubricant comprising:

the lubricant additive composition of claim 1; and an additional base oil, wherein the base oil and the additional base oil are the same or different.

24. The lubricant of claim 23, wherein a weight ratio of the lubricant additive composition to the additional base oil is 1:1 to 1:1000.

25. A method of manufacturing a lubricant additive composition, the method comprising:

contacting a borate comprising an alkali metal borate, an alkaline earth metal borate, or a combination thereof;

tungsten disulfide comprising particles having a particle diameter of 4 to 160 nanometers;

a borate ester;

an anti-scuff agent comprising a metal dithiocarbamate, a metal dialkyldithiocarbamate, a metal dithiophosphate, a metal dialkyldithiophosphate, or a combination thereof; and a base oil under conditions effective to disperse the borate, the tungsten disulfide, the borate ester, and the anti-scuff agent in the base oil to manufacture the lubricant additive composition.

26. The method of claim 25, wherein the conditions effective to disperse the borate, the tungsten disulfide, the borate ester, and the anti-scuff agent in the base oil are effective to form a colloid.

27. The method of claim 26, wherein the conditions effective to form the colloid comprise blending for 1 to 100 minutes at 20 to 150° C., ultrasonically mixing for 1 to 100 minutes, and high-shear mixing for 1 to 100 minutes at 20 to 150° C.

28. The method of claim 27, wherein the ultrasonically mixing comprises treatment with a Sonolator for 1 to 100 minutes at 50 to 150° C.

29. The method of claim 27, wherein the high-shear mixing comprises mixing with high-shear mixer at 2000 to 10000 revolutions per minute for 1 to 100 minutes at 50 to 150° C.

30. The method of claim 25, wherein the method further comprises settling for 1 to 48 hours after the contacting, and filtering after the contacting.

31. A method of manufacturing a lubricant, the method comprising:

contacting the lubricant additive composition manufactured according to claim 25 with an additional base oil, wherein the base oil and the additional base oil are the same or different.

32. A method of lubricating an engine, the method comprising:

providing the lubricant additive composition according to claim 1; and adding the lubricant additive to an engine to lubricate the engine.

33. The lubricant composition of claim 1, wherein a content of the base oil is 5 to 99.9 weight percent, based on a total weight of the lubricant composition.

* * * * *